US005826666A

United States Patent [19]

Tozawa et al.

[11] Patent Number: 5,826,666

[45] Date of Patent: Oct. 27, 1998

[54] APPARATUS AND METHOD FOR CONTROLLING A CONTRUCTION MACHINE

[75] Inventors: Shoji Tozawa, Kobe; Tomoaki Ono, Takasago, both of Japan

[73] Assignee: Shin Caterpillar Mitsubishi, Ltd., Japan

[21] Appl. No.: 712,435

[22] Filed: Sep. 11, 1996

[30] Foreign Application Priority Data

Feb. 21, 1996 [JP] Japan ..... 8-034033
Feb. 21, 1996 [JP] Japan ..... 8-034034

[51] Int. Cl.[6] ..... F16D 31/02; G06F 15/20

[52] U.S. Cl. ..... 172/7; 172/2; 37/348

[58] Field of Search ..... 37/348, 382; 172/2, 172/3, 4–5, 7; 364/124.07, 424.05, 167.01

[56] References Cited

U.S. PATENT DOCUMENTS

| | | | |
|---|---|---|---|
| 4,807,136 | 2/1989 | Rutkowski et al. | 172/7 X |
| 4,910,673 | 3/1990 | Narisawa et al. | 172/2 X |
| 5,398,766 | 3/1995 | Nakayama et al. | 172/2 X |
| 5,488,787 | 2/1996 | Aoyagi et al. | 172/2 X |
| 5,552,690 | 9/1996 | Hiraoka | 318/632 |

FOREIGN PATENT DOCUMENTS

| | | |
|---|---|---|
| 57-092226 | 6/1982 | European Pat. Off. . |
| 0380665 | 8/1990 | European Pat. Off. . |
| 19510376 | 9/1995 | Germany . |
| 56-085037 | 7/1981 | Japan . |
| 61-191728 | 8/1986 | Japan . |
| 62-160325 | 7/1987 | Japan . |
| 62-185928 | 8/1987 | Japan . |
| 63-044029 | 2/1988 | Japan . |
| 63-060329 | 3/1988 | Japan . |
| 9102853 | 3/1991 | WIPO . |
| 9503492 | 2/1995 | WIPO . |

*Primary Examiner*—Michael J. Carone
*Assistant Examiner*—Robert Pezzuto
*Attorney, Agent, or Firm*—Morrison Law Firm

[57] ABSTRACT

The finishing precision and uniformity of hardness of a surface finished by a construction machine, such as back-hoe, is improved by modifying the targets of a position-tracking control system based on work-load applied to the end effector of the construction machine. For example, compaction of a surface, contoured by a position-tracking, back-hoe, can be made more uniform. This is accomplished by adjusting actuator targets, otherwise controlled on the basis of positional and speed constraints, in response to a detected work load acting on the end effector. To detect work load, a hydraulic fluid pressure signal can be applied to a computer which generates target position and speed commands to the feedback system. The control circuit may be arranged to hold work load constant (generating a constant compaction force for example) or, in response to a priority signal, the circuit can give a selected weight to both the positional constraints and the work load constraints. Another benefit of altering position-tracking in response to work load is improved coordination of actuators. For example, the gain of feedback and feedforward signals of a position-tracking control system can be increased when a detected load is heavy, increasing response, and attenuated when the load is light.

20 Claims, 6 Drawing Sheets

APPARATUS AND METHOD FOR CONTROLLING A CONTRUCTION MACHINE

BACKGROUND OF THE INVENTION

The present invention relates to method and apparatus for controlling construction machinery, for example, hydraulic excavators and back hoes.

Referring to FIG. 6 a back-hoe has a revolving upper structure 12 mounted on a lower structure 1. A working portion, in this case a back-hoe 13, is connected to revolving upper structure 12.

Back-hoe 13 has a boom 15*bm* and a stick 15*st* linking boom 15B*m* with a bucket 15*bk*. Boom 15*bm* pivots around its base end where it attaches to super-structure 12. Boom 15*bm* is forced by a boom cylinder 14*bm*. Stick 15*st* pivots from a distal end of boom 15*bm,* forced by a stick cylinder 14*st*. Bucket 15*bk* pivots on a distal end of stick 15*st* and is forced by a bucket cylinder 14*bk*.

Pivot angles of boom 15*bm*, stick 15*st,* and bucket 15*bk* are each detected by resolvers or other appropriate angle sensors 16*bm,* 16*st,* 16*bk*. Signals representing relative angles are input into a controller 21 through feedback loops 18*bm,* 18*st,* 18*bk* and applied to a signal transformer 17 on revolving upper structure 12. Controller 21 includes a microcomputer.

A display switch panel 22 serves as a human-interface. Display switch panel 22 is connected to a controller 21. Inputs applied to controller 21 include a control switch 23, an engine pump controller 24, a pressure sensor 25, and an inclination sensor 26. A control switch 23 on an operating lever is used by an operator to initiate automatic control or control the engine speed. Engine pump controller 24 controls an engine (not shown) and a pump based on the engine speed detected by an engine speed sensor 24*a*. Pressure sensor 25 detects the position of the operating lever. Inclination sensor 26 detects the angle of inclination of the vehicle. A solenoid valve 27 is connected to an output terminal of controller 21.

Controller 21 has a closed-loop control compensator for controlling boom cylinder 14*bm*, stick cylinder 14*st*, and bucket cylinder 14*bk*. With the closed-loop control compensator, controller 21 forms a position-tracing feedback control system. The system constantly monitors operating strokes of the respective cylinders. It performs feedback control of the actual positions and speeds of boom 15*bm*, stick 15*st*, and bucket 15*bk* by comparing command signals from the operating lever with signals representing rotation angles of boom 15*bm*, stick 15*st*, and bucket 15*bk,* fed back from angle sensors 16*bm*, 16*st*, 16*bk*. For the construction machine to perform operations like horizontal leveling or slope finishing, controller 21 electrically controls proportional control solenoid valves (not shown) indirectly, using signals calculated by the closed-loop control compensator to eliminate the difference (error) between the feedback signals (from angle sensors 16*bm,* 16*st,* 16*bk*) and the signals representing target values computed by the microcomputer. Boom cylinder 14*bm*, stick cylinder 14*st* and bucket cylinder 14*bk* are extended or contracted by means of pilot control of control valves (not shown) using pilot pressure (generated by the proportional control solenoid valves. Controller 21 is thus capable of automatically maintaining the bucket at a constant angle or the tip of the bucket teeth in a constant plane during such operation as horizontal leveling or slope finishing.

The position of the bucket is controlled automatically, using a microcomputer, to maintain the bucket angle and constrain to specified loci the tip of the bucket teeth during horizontal leveling or slope finishing. In a conventional hydraulic excavator, typically, a closed-loop control is used in which signals output by angle sensors 16*bm,* 16*st*, 16*bk* of the respective articulating elements of the working tool (back-hoe, in this case) are fed back to controller 21. Controller 21 outputs final control signals to minimize the deviation of cylinders 14*bm*, 14*st*, 14*bk* (which control the positions of boom 15*bm,* stick 15*st*, and bucket 15*bk*) from the computed constraints based on the bucket positional constraints.

According to the control mechanism of the prior art, however, the work load of bucket 15*bk* (the loads born by cylinders 14*bm*, 14*st*, 14*bk*) is regarded merely as a disturbance. Factors such as compaction force applied to the surface by excavation are excluded and are not subjects of the control system. That is, there are no preset target values for such load-related variables. As a result, not only is there no guarantee of uniform hardness of the finished surface, but there is also the possibility of a decrease in finishing precision, caused by fluctuation in digging force. In addition, the operating efficiency of the tool may deteriorate because of a decrease in cylinder speed when excessive work load is applied.

When the excavation work load of bucket 15*bk* increases during the excavation, in other words when disturbance increases in the control system, work load of boom cylinder 14*bm* increases as compared to when the digging work load is small. This delays follow-up movement of the boom 15*bm*. Thus, the actual surface formed by excavation can deviate from the target surface defined by the positional constraints on the tool (bucket, in this case). In other words, the various articulating members can fall out oft synch since each cylinder may experience a different change in load. When a delay occurs during horizontal leveling or ground finishing, poor finishing precision is the result.

To counter this problem, an integrating factor may be added to the closed-loop compensator in order to reduce the difference between a target position and the actual position of boom cylinder 14*bm*. However, merely tossing in an integral compensation term presents problems. For example, an a large integral term can slow follow-up movement, which can also cause the articulating members to fall out of synch due to sluggish response to rapid changes in work load. In addition, control system instability may result, depending on the positions of the linkages. For these reasons, an integrating factor is not permitted to have a large gain. Therefore, it is difficult to make use of the effect of the integrating factor to the extent desired.

OBJECTS AND SUMMARY OF THE INVENTION

An object of the present invention is to provide a control method and apparatus for a construction machine which is capable of improving the precision and the uniformity of hardness of the finished surface.

Another object of the present invention is to automatically control a construction machine by tracking positions of as well as the load of the moving elements of a working tool and/or derivatives of such loads to determine such variables as digging force and compaction force.

Another object of the invention is to improve tracking and coordination of movement of movable elements of a construction tool, thereby ensuring a specified finishing precision even when digging work load varies during horizontal leveling, ground finishing, or any other operation requiring controlled and coordinated movement of a tool.

Briefly, the finishing precision and uniformity of hardness of a surface finished by a construction machine, such as back-hoe, is improved by modifying the targets of a position-tracking control system based oil work-load applied to the end effector of the construction machine. For example, compaction of a surface, contoured by a position-tracking back-hoe, can be made more uniform. This is accomplished by adjusting actuator targets, otherwise controlled on the basis of positional and speed constraints, in response to a detected work load acting on the end effector. To detect work load, a hydraulic fluid pressure signal can be applied to a computer which generates target position and speed commands to the feedback system. The control circuit may be arranged to hold work load constant (generating a constant compaction force for example) or, in response to a priority signal, the circuit can give a selected weight to both the positional constraints and the work load constraints. Another benefit of altering position-tracking in response to work load is improved coordination of actuators. For example, the gain of feedback and feedforward signals of a position-tracking control system can be increased when a detected load is heavy, increasing response, and attenuated when the load is light.

The present invention implements a control method for controlling movement of the end effector of a construction machine and particularly to such machines that employ a feedback control system to control respective positions of the end effector actuating cylinders. In the present invention, the work load of the end effector is detected by detecting, cylinder work load pressure applied to the end effector actuating cylinder or end effector actuating cylinders. Target values for the feedback control system that performs position tracking are determined responsively to the work load feedback signals. According to this method, the work load of the end effector, for example compaction force, is detected by measuring cylinder work load pressure, and the position of the end effector actuating cylinder is controlled to maintain a desired compaction force and the like. For example, the compaction force is reduced by raising the bucket or increased by lowering the bucket responsively to the detected work load. The position-tracking feedback control system thus performs feedback control to maintain the work load of the end effector, such as digging force and compaction force, by means of detecting cylinder work load pressure applied to the end effector actuating cylinders. Thus, the invention is capable of improving finishing precision by using an existing feedback control system for position tracking innate to the machine and also capable of regulating hardness of the finished surface by controlling compaction force and/or other work loads of the end effector. This is accomplished by using an end effector work load feedback control system.

The invention also implements a control method for the end effector of a construction machine wherein the relative priority of position-tracking control versus work load control can be selected. Thus, if priority is given to the end effector work load control, the tool is controlled to maintain a desired compaction force or other variable derived from the work load. If priority is given to the end effector position-tracking control, the tool is controlled to constrain movement to a desired locus of points. Balancing priority between position-tracking control and end effector work load control has various merits. For example, the higher the degree of priority on end effector work load control, the more uniform is the hardness of a finished surface. Furthermore, should overload occur, decrease in operating efficiency can be minimized by giving priority to end effector work load control over position tracking control, thereby preventing reduction of cylinder speed.

The invention also implements a control method for a construction machine, and particularly to a control method in which the derivative variable made the target of control is compaction force. More particularly, in this method, the compaction force generated by the equipment's end effector is controlled by controlling the vertical position of the end effector. In this method, the compaction force, corresponding to the load on the end effector, is feedback controlled to remain constant as the position-tracking feedback control system controls the vertical position of the equipment. According to this feature of the invention, by adjusting targets of the position-tracking feedback control system that vertically controls the position of the end effector responsively, it is possible to implement feedback control of compaction force in a position-tracking control system.

The invention also implements an apparatus for controlling the end effector of a construction machine that employs a feedback control system to control respective positions of the end effector actuating cylinders. The control apparatus includes a work load pressure detector to detect work load of the end effector by detecting pressures of the end effector actuating cylinders. In also includes an end effector work load setting device which determines target values for the position-tracking feedback control system by comparing with feedback signals generated from end effector work load. In this way, the height of the end effector is automatically adjusted so that the end effector work load detected by the work load pressure detector corresponds to a preset value input by a user through a variable control. The automatic adjustment, for example in the case of compaction force, raises the end effector to reduce the compaction force or lowers the end effector to increase the compaction force. The position-tracking feedback control system thus performs feedback control to maintain the end effector work load at a set value by using the work load pressure detector to detect work load of the end effector. Target values for the work load of the effector work load are adjusted using a load-setting control. According to an embodiment of the invention, the control is capable of ensuring a specified finishing precision by using an existing position-tracking feedback control system innate to the machine. In addition, the invention can provide for uniform hardness of a finished surface by controlling compaction force and other work loads of the end effector.

The invention also implements an apparatus for controlling the end effector of a construction machine capable of accepting the input of a target value for equipment work load and for accepting input of a variable priority between work load and position tracking. In cases where priority is given by the priority setting device to the end effector work load control, a desired end effector work load is maintained constant. To improve surface finish, a higher priority can be given to position tracking. The latter is accomplished, according to an embodiment of the invention, by causing the priority setting device to reduce the degree of priority to end effector work load control, thereby giving higher priority to position-tracking control. By using the priority setting device, it is possible to choose the mode of control according to the nature of work between the control mode that calls for giving priority to end effector work load control and the other mode that calls for giving priority to position-tracking control. Thus, the invention is capable of coping with different types of operations: ones that place stress on uniformity of digging force or compaction force and others that place priority on precision in position tracking, such as operations requiring a precise surface finish or slope gradient.

The invention also implements an apparatus for controlling the end effector of a construction machine that employs a feedback control system to control respective positions of the end effector actuating cylinders the apparatus including a feedforward loop positioned in the position-tracking feedback control system, and a feedforward gain adjusting means for adjusting the gain of the feedforward loop in accordance with digging work load, wherein the ability of position tracking with respect to digging work load is improved by increasing or reducing the gain of feedforward signals according to digging work load. As a feedforward loop is thus added to the feedback control system that controls positions of the end effector actuating cylinders, the invention improves efficiency of position tracking of the end effector actuating cylinders. Furthermore, by using a gain adjusting means to adjust the gain of the aforementioned feedforward loop according to digging work load, deviation of the actual position of a cylinder from its target position is reduced. Therefore, precision of position tracking of the end effector actuating cylinders, irrespective of digging work load, is improved. A specified finishing precision is ensured even if digging work load increases during ground preparation work, such as horizontal leveling or slope finishing. In cases where the digging work load is small, the gain is automatically lowered, thereby ensuring stability of the control system.

The invention also implements an apparatus for controlling the end effector of a construction machine by adjusting a feedforward gain responsively to pressure sensors installed to detect cylinder work load pressure of the end effector actuating cylinder(s). Gain is adjusted according to a look-up table stored in memory. The look-up table defines a relationship between the cylinder work load pressure detected by the pressure sensors and the gain. Cylinder work load pressure applied to a end effector is detected and the cylinder actuated responsively to the pressure detected by retrieving a desired gain that corresponds to the detected cylinder work load pressure from a memory. The gain of the feedforward loop is then automatically adjusted to the desired gain. Thus, an embodiment of the invention is enabled to accomplish feedforward control in spite of changes in digging work load.

The invention also implements an apparatus for controlling the end effector of a construction machine that employs a feedback control system for tracking respective positions of the end effector actuating cylinders. The apparatus includes a feedforward loop positioned in the position-tracking feedback control system. Gain of the feedforward loop is adjusted in accordance with digging work load using a in accordance with digging work load. In addition, according to this embodiment, a feedback gain of the position-tracking feedback system is adjusted in accordance with digging work load. Precision of position tracking with respect to digging work load is improved by increasing or reducing respective gain of feedforward signals and feedback signals according to digging work load. By using adjusting the gain of the feedforward loop and adjusting the gain of the position-tracking feedback control system in accordance with digging work load, the invention can optimize both the feedforward gain and the feedback gain by reducing or increasing the respective gains according to digging work load. Therefore, according to the invention, precision of tracking positions of the end effector actuating cylinders with respect to digging work load is improved, even if digging work load increases during ground preparation work, such as horizontal leveling or slope finishing. The system also provides that, in cases where digging work load is small, the gains may be adjusted to a low level, thereby ensuring stability of the control system.

The invention also implements an apparatus for controlling the end effector of a construction machine wherein feedforward and feedback gain are adjusted according to pressure sensors that detect cylinder work load pressure of the end effector actuating cylinders. The invention has gain adjusting memories that store respective look-up tables. Each look-up table defines a relationship between a respective cylinder work load pressure detected by corresponding pressure sensors and a respective one of the feedforward gain and the feedback gain. According to a control procedure of the apparatus the cylinder work load pressures are detected, the gains are retrieved from the respective look-up tables, and the gain of the feedforward and feedback signals adjusted accordingly. Thus, an apparatus according to the invention can feedforward control even with significant changes in digging work load. This is because, according to the above procedure, the gains of feedforward signals and feedback signals are adjusted with respect to the change of cylinder work load pressure detected by the pressure sensors.

According to an embodiment of the present invention, there is provided, a control method for controlling a piece of construction equipment that has a position-sensing, feedback control system to track respective positions of an actuator that control positions of an end effector, comprising the steps of: generating a target value for an actual force-load acting on the actuator generated in response to a forcing of the end effector against a working material, detecting the actual force-load and modifying a control signal of the feedback control system responsively to a result of the step of detecting and the target value.

According to another embodiment of the present invention, there is provided, an apparatus for controlling an end effector of a construction machine that employs a feedback control system to track respective positions of actuating cylinders that move the end effector, comprising: a pressure sensor connected to the actuator to communicate with a hydraulic fluid whose pressure is responsive to a work load affecting the end effector, a work load-setting indicator to allow a user to set a desired signal indicating a target work load, a work load control portion connected to receive the signal indicating a target work load, the work load control portion being connected to the feedback control system to track respective positions such that a tracking of the feedback control system is responsive to the signal indicating a desired work load and a pressure signal of the pressure sensor.

According to still another embodiment of the present invention, there is provided, an apparatus for controlling the end effector of a construction machine that employs a feedback control system for tracking respective positions of end effector actuating cylinders, the apparatus including: a feedforward loop in the position-tracking feedback control system, a feedforward amplifier in the feedforward to adjust a gain of the feedforward loop, a detector, connected to the feedforward amplifier, for detecting a digging work load, the gain of the feedforward amplifier being continuously adjustable responsively to the detector; and a feedback loop with a feedback amplifier in the feedback loop to adjust a gain of a feedback signal of the feedback loop, the gain of the feedback amplifier being continuously adjustable responsively to the detector.

According to still another embodiment of the present invention, there is provided, a method of controlling a hydraulic construction machine having a feedback position control system, comprising the steps of: storing an indication of a desired position constraint for an end effector of the construction machine, storing an indication of a desired speed of the end effector, monitoring a working force applied to the end effector, a signal responsive to a position of the end effector being applied through a feedback loop of the feedback position control system, amplifying the signal responsively to results of the step of monitoring a working force.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
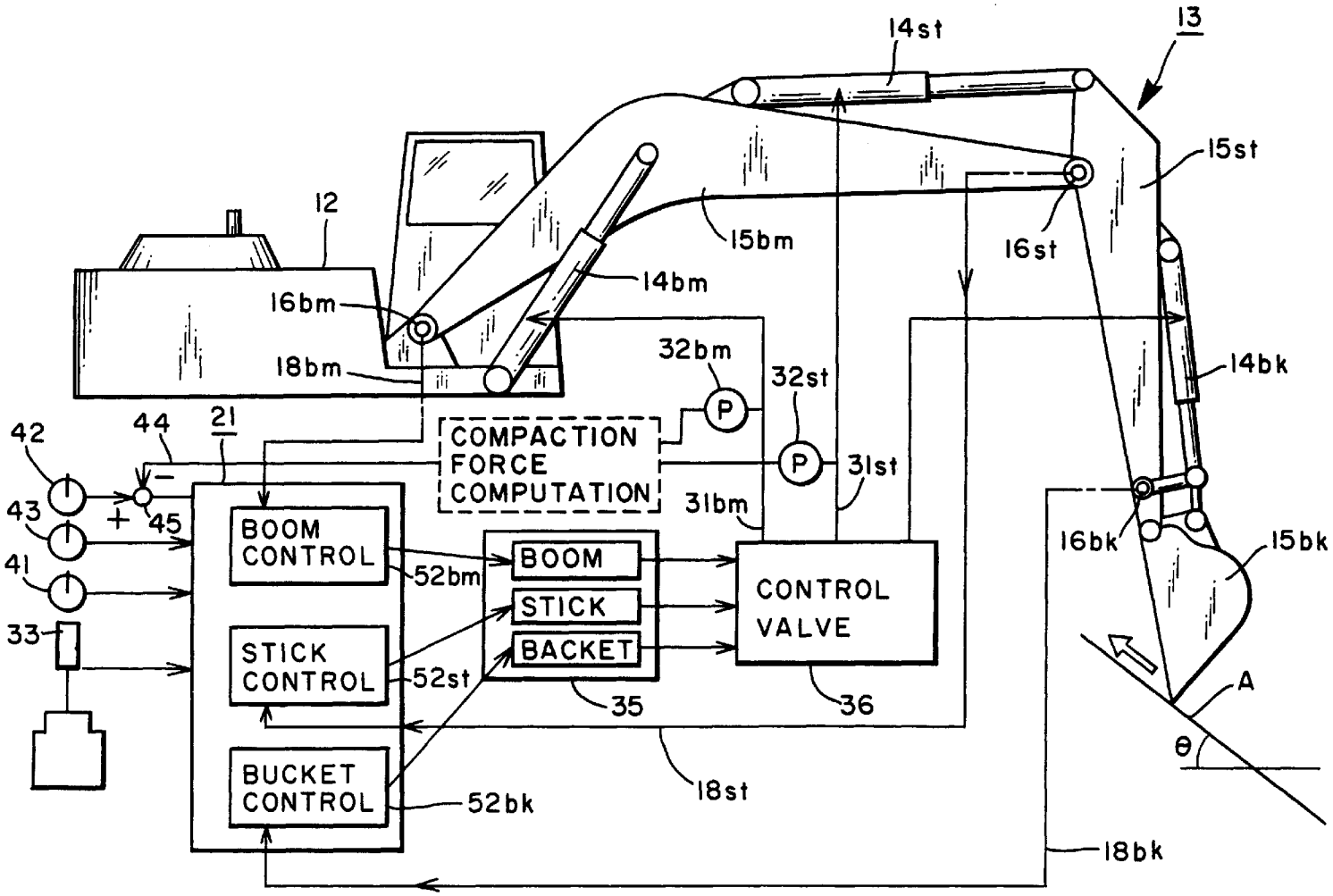
FIG. 1 is a system block diagram of a end effector control apparatus for a construction machine according to an embodiment of the present invention.

Referring to FIG. 1 a front end effector has a boom cylinder 14*bm,* a stick cylinder 14*st*, and a bucket cylinder 14*bk*, which may be collectively referred to as end effector actuating cylinders 14. End effector actuating cylinders move an articulating front linkage that consists of a boom 15*bm,* a stick 15*st*, and a bucket 15*bk*.

A controller 21 controls the end effector. A stick operating lever 33 applies a signal indicating a target speed of the bucket teeth in the direction of digging. A slope gradient setting, device 41 sets a target gradient θ of the finished surface slope A. A compaction force setting device 42 indicates a target compaction force. The priority setting device 43 establishes a balance between the competing priorities of constraining the geometry of movement (e.g., raking the bucket teeth through a plane) and maintaining a constant compaction force. The respective target values for the two types of control are set by slope gradient setting device 41 and compaction force setting device 42, respectively.

Controller 21 generates signals output to proportional control solenoid valves 35. Proportional control solenoid valves output pilot pressures in proportion to electrical signals applied by controller 21. Control valves 36 control pressures and volume rate of hydraulic fluid fed from a hydraulic source (not shown) to end effector actuating cylinders 14. Control valves 36 perform this control by regulating the positions of spools Using pilot pressures generated by proportional control solenoid valves 35.

Furthermore, position-tracking feedback loops 18*bm*, 18*st,* 18*bk,* collectively referred to as feedback loops 18, are applied to controller 21 by angle sensors 16*bm*, 16*st*, 16*bk*, respectively. Angle sensors 16*bm*, 16*st,* 16*bk* detect respective rotation angles of the articulations connecting superstructure 12, boom 15*bm,* stick 15*st* and bucket 15*bk,* respectively. The above elements form a closed-loop control system. The angle sensors 16*bm*, 16*st*, 16*bk* may be resolvers, encoders, or any suitable devices. Angle sensors 16*bm,* 16*st*, 16*bk* are collectively referred to as angle sensors 16.

Hydraulic fluid feed and discharge lines 31*bm,* 31*st* to boom cylinder 14*bm* and stick cylinder 14*st* are respectively provided with pressure detectors 32*bm*, 32*st*. Pressure detectors 32*bm*, 32*st* detect work load pressure applied to boom cylinder 14*bm* and stick cylinder 14*st*. These pressures, together with position information, can be used to indicate the force of contact between bucket 15*bk* and surface A. For example, a compaction force generated by moving bucket 15*bk* vertically is indicated through the cylinder work load pressure, especially of boom cylinder 14*bm*.

Compaction force can be computed by multiplying the cylinder work load pressure of boom cylinder 14*bm* by the actual area of the inner surface of the cylinder receiving the pressure. The digging force can be computed by multiplying the cylinder work load pressure of stick cylinder 14*st* by the actual area of the inner surface of the cylinder receiving the pressure.

An end effector work load feedback loop 44 for cylinder work load detected by pressure detectors 32*bm*, 32*st* is applied by pressure detectors 32*bm*, 32*st* to controller 21. Controller 21 has closed-loop control compensators 52*b*, 52*st,* 52*bk* for controlling respective end effector actuating cylinders 14. Controller 21 constantly monitors the actual positions and speeds of boom 15*bm,* stick 15*st,* and bucket 15*bk*. Controller 21 also indirectly monitors the working, positions and speeds of respective end effector actuating cylinders 14 through signals representing the rotational angles and angular velocities of boom 15*bm*, stick 15*st,* and bucket 15*bk*. The latter signals are detected and fed back to controller 21 by angle sensors 16. Controller 21 performs feedback control of control valves 36, through proportional control solenoid valves 35, of boom 15*bm,* stick 15*st* and bucket 15*bk* in response to command signals from slope gradient setting device 41 and operating lever 33. These command signals determine the positions and speeds of the front linkage, respectively.

During horizontal leveling or slope finishing, respective proportional control solenoid valves 35 for boom 15*bm,* stick 15*st,* and bucket 15*bk* are electrically controlled based on signals computed by closed-loop control compensators 52*b*, 52*st,* 52*bk*. The signals computed by the compensators eliminate the difference between the feedback signals and the target signals computed by the microcomputer. This automatically constrains the bucket teeth to a defined locus of points and keeps the bucket angle constant during horizontal leveling or slope finishing. Control is effected through proportional control solenoid valves 35, which control pilot pressure to the spools of control valves 36 for corresponding cylinders 14*bm*, 14*st* and a 4*bk* to move boom 15*bm*, the stick 15*st*, and bucket 15*bk*.

Figure 2:
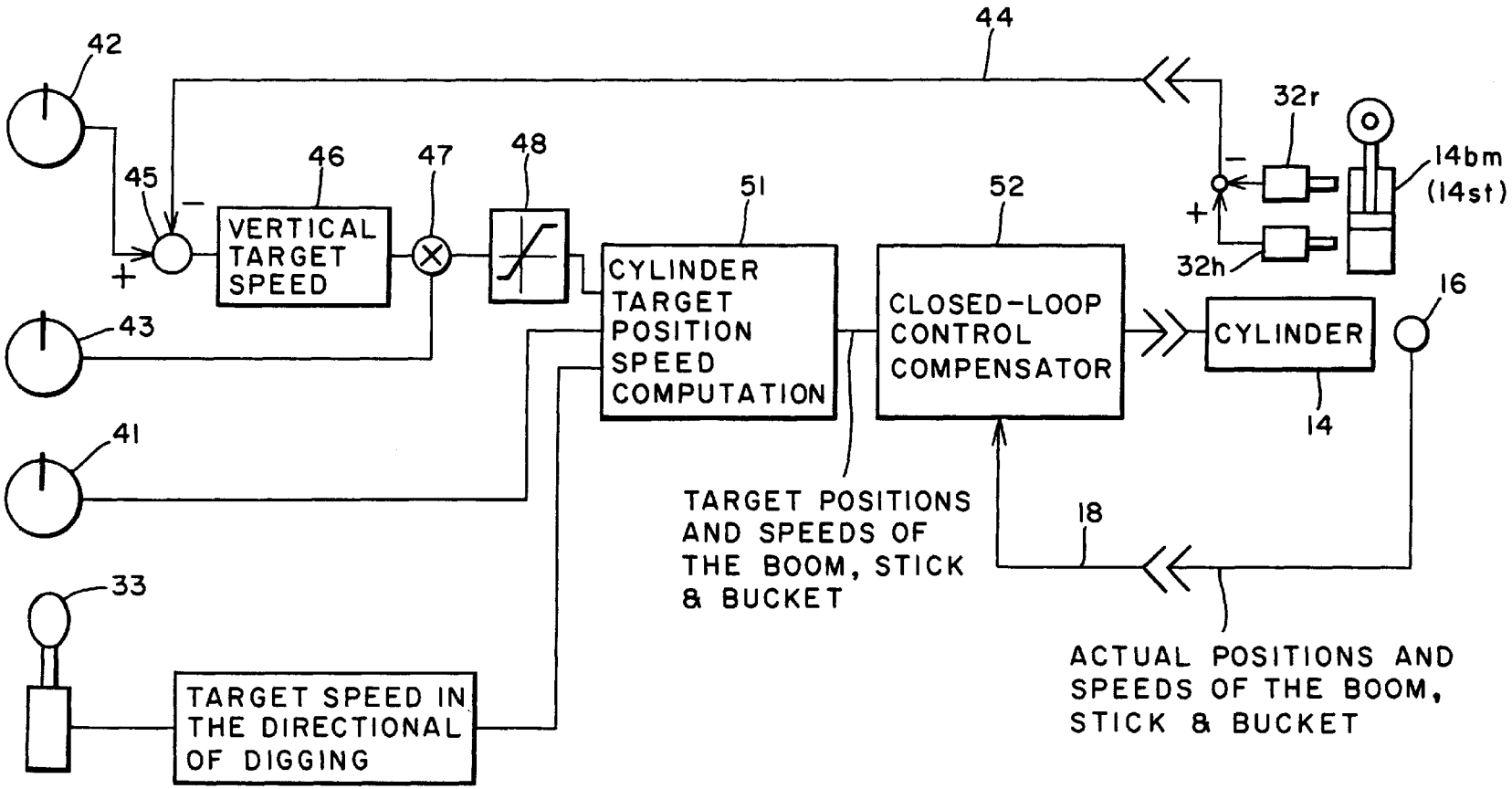
FIG. 2 is a block diagram of the controller of the end effector control apparatus shown in FIG. 1.

Referring to FIG. 2, each of the pressure detectors 32*bm* and 32*st* is a differential pressure indicator composed of a pressure sensor 32*h* and a pressure sensor 32*r* respectively provided at the extension-side (the head-side) and the contraction-side (the rod-side) of the corresponding cylinder. Thus, each of pressure detectors 32*bm* and 32*st* detects cylinder work load pressure, that is, the difference between the work load pressure detected by pressure sensor 32*h* at the extension-side and the work load pressure detected by pressure sensor 32*r* at the contraction-side.

Feedback loop 44 and compaction force setting device 42 apply either respective signals to a comparator 45. The output of comparator 45 is connected to a computing unit 46 that computes target speed in the vertical direction of the tip of the bucket teeth. The vertical target speed signal generated by computing unit 46 is gain-adjusted by a multiplier 47 and peak-limited by a limiter 48. The adjusted and limited signal is applied to a computing unit 51. The gain of multiplier 47 is determined according to a signal from priority setting device 43. Limiter 48 sets the upper and lower limits of vertical target speed of the bucket teeth that influence compaction force. Computing unit 51 has a microcomputer (not shown) which computes respective target positions and speeds of end effector actuating cylinders 14.

Computing unit 51 applies a signal indicating computed target values to closed-loop control compensators 52. Each closed-loop control compensator 52 has a compensating circuit that improves control characteristics, such as stability, response speed and steady-state deviation, so to insure that detection signals representing an actual position and speed of boom 15*bm,* stick 15*st* or bucket 15*st,* fed back through feedback loop 18, precisely follow target signals for actuating the corresponding cylinder. That is, the target position and speed of boom 15*bm*, stick 15*st*, or bucket 15*st*, output from computing unit 51 performs horizontal leveling slope finishing or compaction force within controlled limits. Through the compensating circuits described above, respective closed-loop control compensators 52 output electrical signals, thereby proportionally controlling solenoid valves 35 for boom 15*bm*, stick 15*st* or bucket 15*st* using output electrical signals.

Referring now also to FIG. 3, the embodiment described immediately above is operated as follows. First, the user sets a finished slope gradient θ for ground preparation of slope A by adjusting above slope gradient setting device 41. Then, the user moves stick operating lever 33 to command the target speed of the bucket teeth in the direction of digging. This causes computing unit 51 to compute and output the respective target positions and speeds of end effector actuating cylinders 14.

Meanwhile, comparator 45 compares the difference between the pressures which have been detected by pressure sensors 32*h,* 32*r* provided at the extension side and the contraction side of the respective end effector actuating cylinders 14 with the value set by compaction force setting device 42. The height of the bucket is then automatically adjusted so that each difference in pressure conforms with the target value for the corresponding cylinder. To be more specific, bucket 15*bk* is raised in order to reduce the compaction force on the ground surface or lowered to increase the compaction force.

Although the tips of the bucket teeth deviate from the preset target locus, the deviation can be negated by priority setting device 43 that sets a degree of priority between position follow-up control and cylinder work load control. In other words, the priority can be set to favor position follow-up control strongly (or 100%) so as to make the actual cylinder pressures conform with the target pressures and conventional bucket teeth locus control, i.e. cylinder position follow-up control.

Figure 3A:
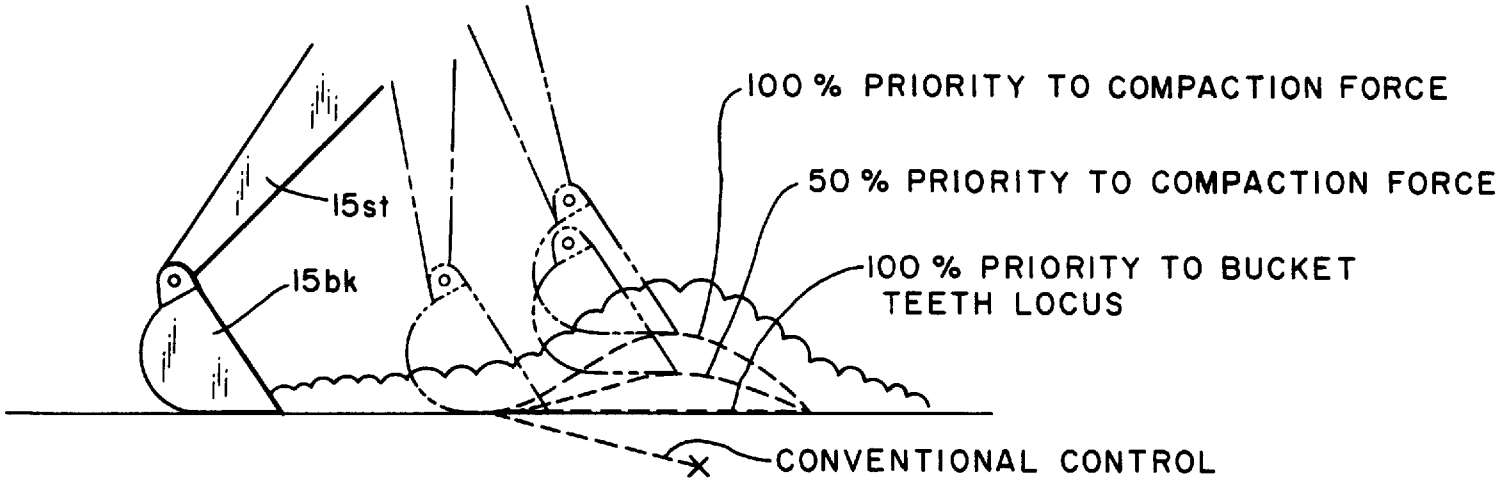
FIG. 3(A) is an explanatory drawing illustrating examples of loci of the tip of the bucket teeth, wherein the loci differ depending on the degree of priority in bucket teeth locus control and compaction force control by using said apparatus.

As is apparent in the example shown in FIG. 3(A), giving priority to bucket teeth locus control improves the locus of points defined by movement of the bucket teeth. In other words, it improves the precision of the surface finish. In this case, however, digging force, represented by a solid line in FIG. 3(B) may fluctuate.

Figure 3B:
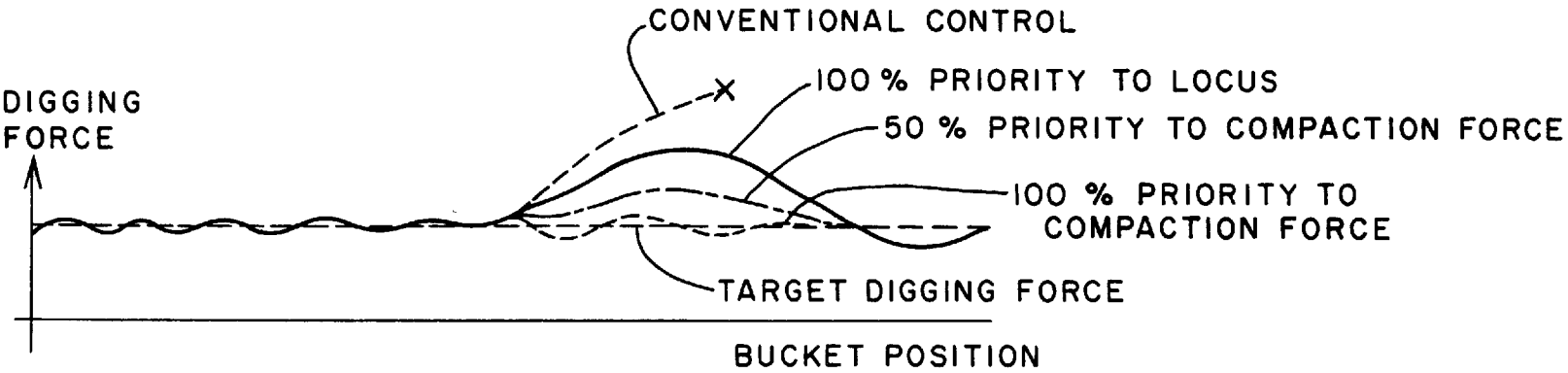
FIG. 3(B) is a graph illustrating changes in digging force which differ depending said degree of priority.

As shown in the examples represented by thick broken lines along the line representing the target digging force in FIG. 3(B), giving priority to compaction force control enables precision control of compaction force while maintaining an approximately constant digging force. In that case, however, the locus of points defined by the movement of the bucket teeth is prone to deviation from the presumed straight line target, as is apparent in the uppermost broken line in FIG. 3(A).

The target locus of the bucket teeth and the target compaction force (the target cylinder work load pressure) may be set using slope gradient setting device 41 and compaction force setting device 42. A degree of priority between the two control goals (compaction force control goal and bucket teeth locus control goal) can be set using priority setting device 43. With the above apparatus, by establishing these settings, it is possible to adjust the finishing precision and the hardness of the finished surface or a desired combination. That is, the user can make a choice as to which should be given greater importance in accordance with the demands of the particular operation.

With the above apparatus, it is possible to control compaction force by semi-automatically raising or lowering bucket 15*bk* according to the above-mentioned degree of priority. This is because bucket 15*bk,* while moving along the surface to be finished, also applies a surface-normal force that compacts the surface to be finished.

Figure 4:
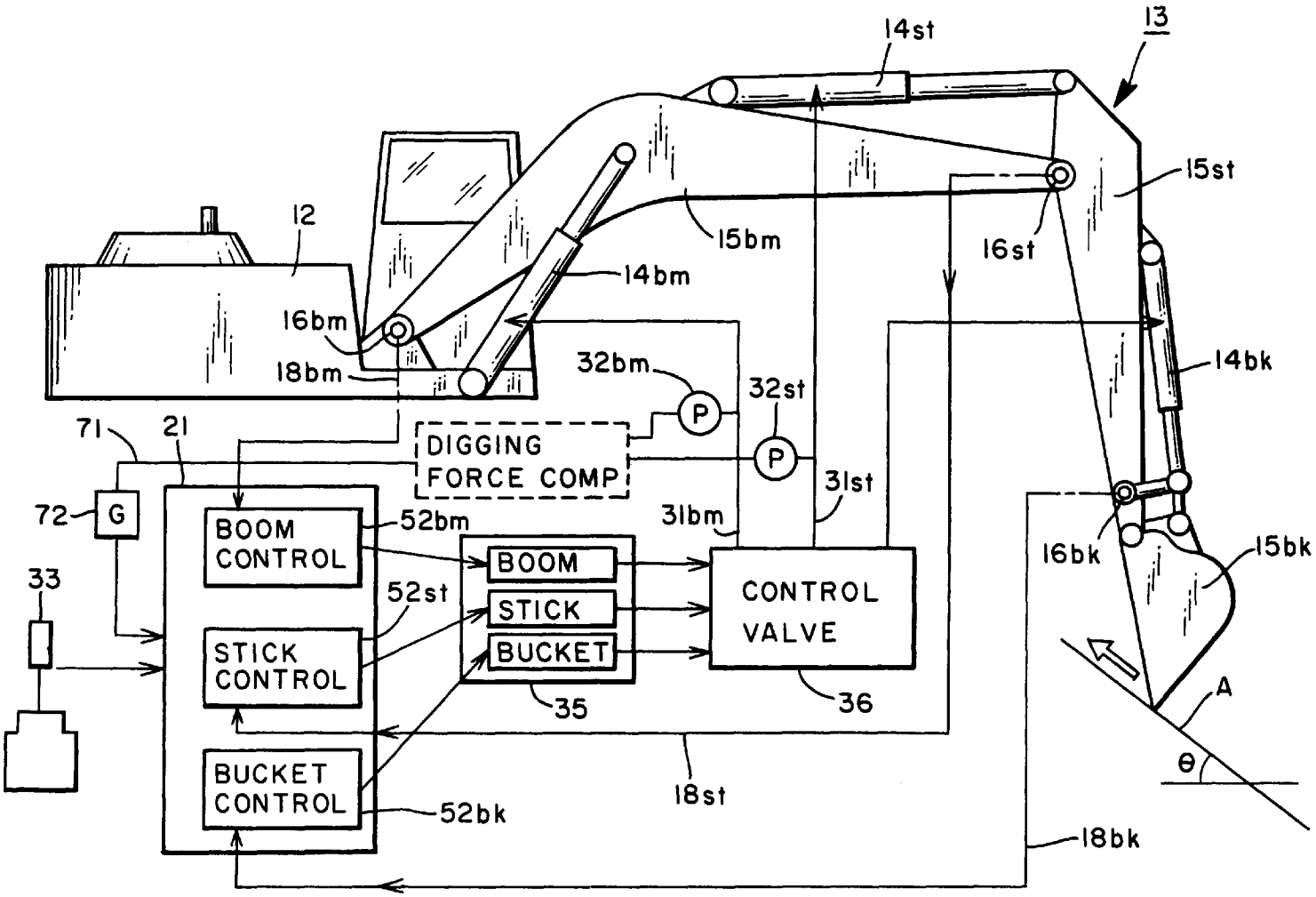
FIG. 4 is a system block diagram of a end effector control apparatus for a construction machine according to another embodiment of the present invention.
Figure 5:
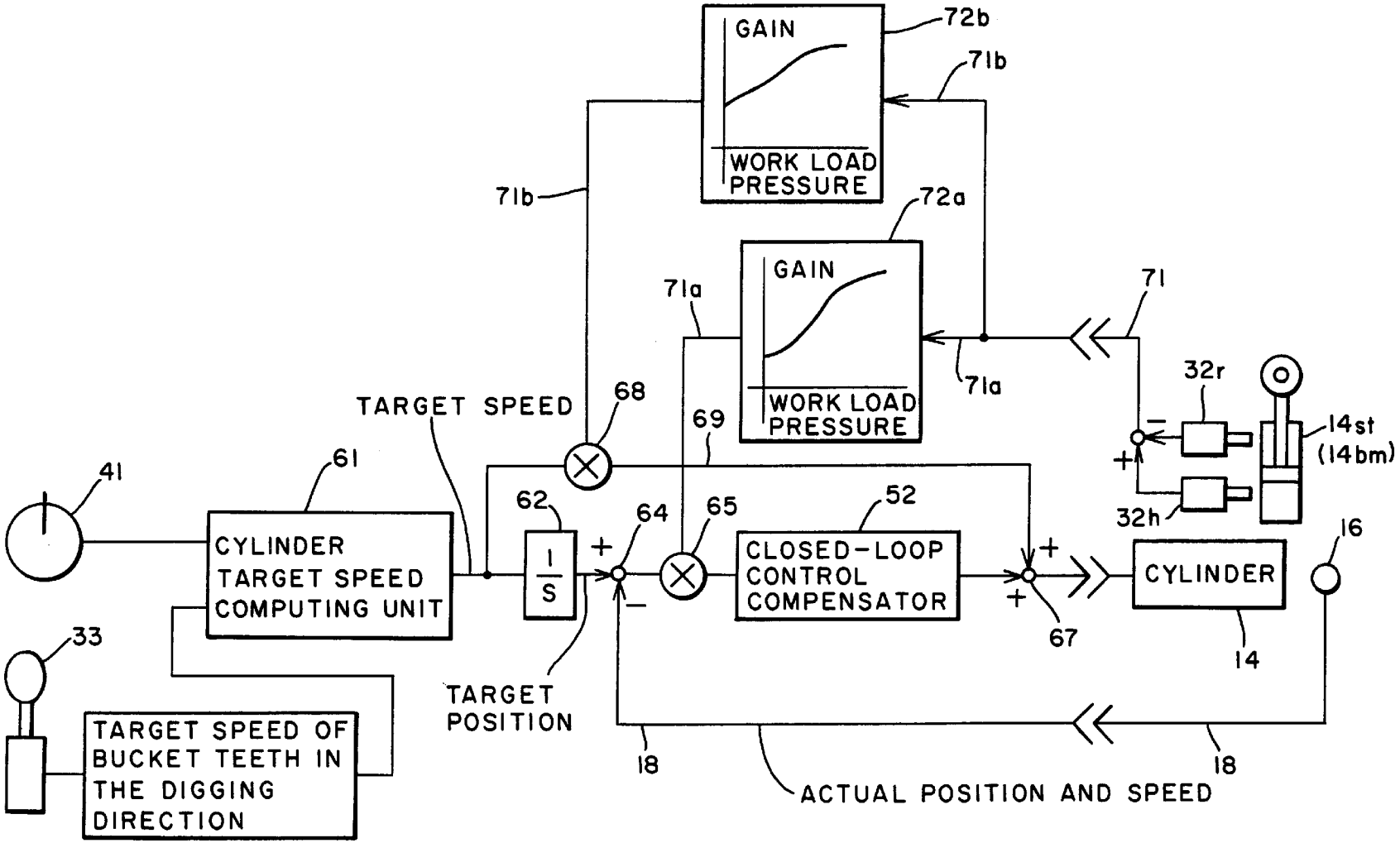
FIG. 5 is a block diagram of the controller of the end effector control apparatus shown in FIG. 4.
Figure 6:
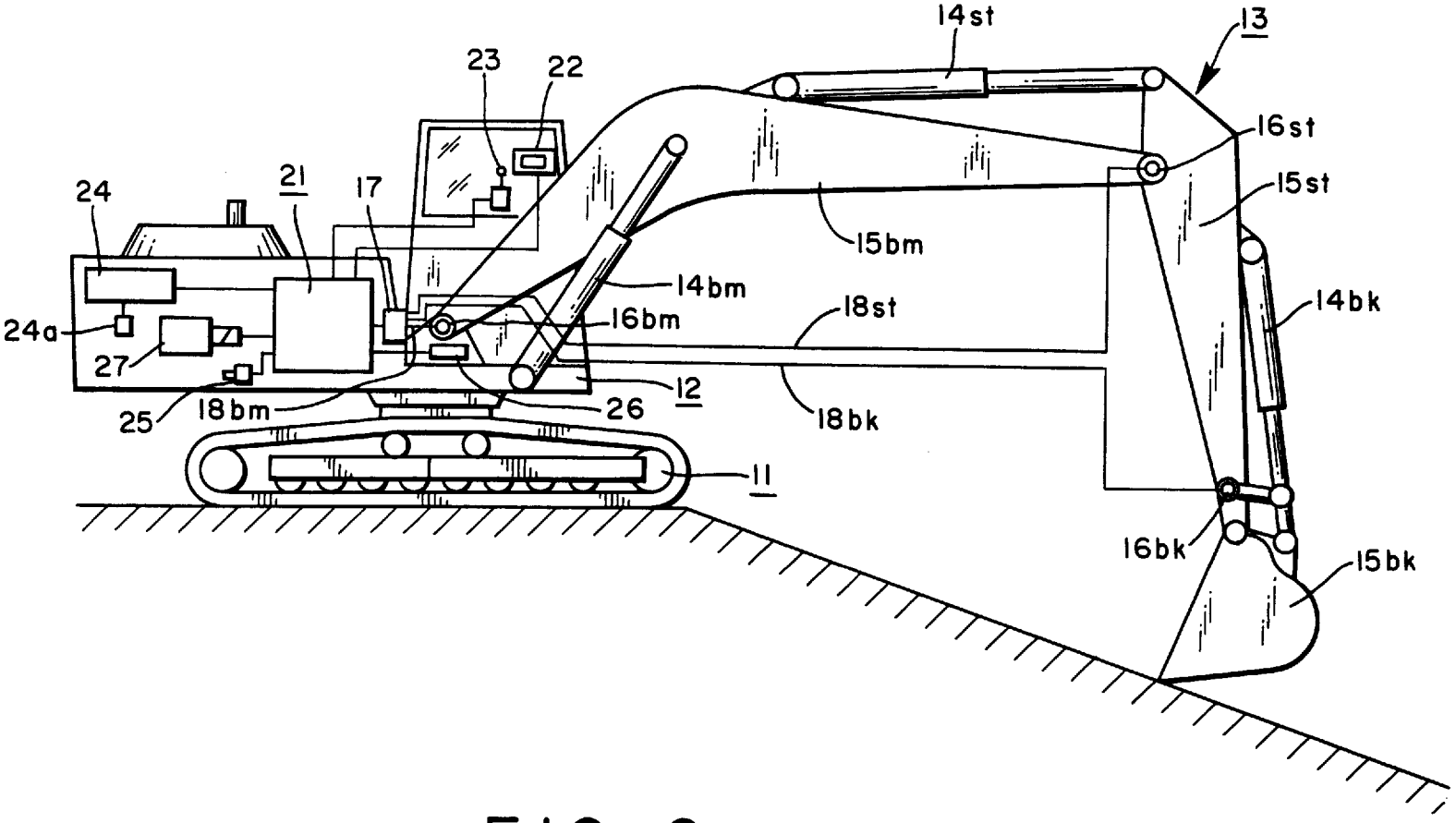
FIG. 6 is an explanatory drawing illustrating the system configuration of a conventional hydraulic excavator.

Referring now to FIGS. 4 and 5, another embodiment of the invention, includes a front end effector powered by a boom cylinder 14*bm,* a stick cylinder 14*st* and a bucket cylinder 14*bk*, collectively referred to as end effector actuating cylinders 14. The front end effector includes a front linkage that consisting of a boom 15*bm*, a stick 15*st*, and a bucket 15*bk*.

A position-tracking feedback control system includes a controller 21, which serves as the principal member to control the front end effector. A stick operating lever 33 applies to controller 21 a signal indicating a target speed of the bucket teeth in the direction of digging. Proportional control solenoid valves 35 output pilot pressures in proportion to electrical signals applied thereto by controller 21. Control valves 36 control pressures and quantities of hydraulic fluid fed from a hydraulic source (not shown) to end effector actuating cylinders 14. Control valves 36 perform control by means of spools whose positions are controlled by pilot pressures from proportional control solenoid valves 35. Angle sensors 16*bm,* 16*st,* and 16*bk,* collectively referred to as angle sensors 16, respectively detect rotation angles of boom 15*bm*, stick 15*st*, and bucket 15*bk*. Feedback loops 18*bm,* 18*st,* and 18*bk,* collectively referred to as feedback loops 18, connect respective angle sensors 16 to controller 21.

Hydraulic fluid feed and discharge lines 31*bm,* 31*st* to boom cylinder 14*bm* and stick cylinder 14*st* are respectively provided with pressure detectors 32*bm*, 32*st*. Pressure detectors 32*bm*, 32*st* detect a work load pressure applied to boom cylinder 14*bm* and stick cylinder 14*st*. The work load of a digging operation (the digging force) can be computed by multiplying the cylinder work load pressure by the actual area of the inner surface of the cylinder receiving the pressure.

As the load on stick cylinder 14*st* during horizontal leveling or slope finishing changes substantially, pressure detector 32*st* for stick cylinder 14*st* is indispensable. On the other hand, as load change on boom cylinder 14*bm* is minimal, pressure detector 32*bm* for boom cylinder 14*bm* may optionally be omitted from the control system.

A compaction force signal 71 is computed from cylinder work load detected by pressure detectors 32*bm*, 32*st* is provided from pressure detectors 32*bm*, 32 *st* and applied to feedback and feedforward controller 21. Lookup tables 72*a* and 72*b* (collectively, 72) adjust the gain feedback signal 71, producing feedback signals 71*a* and 71*b*. Lookup tables 72 reduce or increase feedback gain or feedforward gain according to cylinder work load pressure (the digging work load).

Controller 21 is provided with closed-loop control compensators 52*bm*, 52*st*, and 52*bk*, collectively referred to as closed-loop control compensators 52. Controller 21 controls respective end effector actuating cylinders 14 by constantly monitoring actual positions and speeds of boom 15*bm*, stick 15*st*, and bucket 15*bk*. Controller 21 also indirectly monitors the working positions and speeds of end effector actuating cylinders 14 through signals that represent the respective rotational angles and angular velocities of boom 15*bm*, stick 15*st* and bucket 15*bk* fed back to controller 21 by angle sensors 16, the positions and speeds being calculatable based on the known geometry of the front linkage. Controller 21 performs feedback control of control valves 36, through proportional control solenoid valves 35, to cause boom 15*bm*, stick 15*st*, and bucket 15*bk* to follow command signals that determine the target positions and speeds of the front linkage.

Referring to FIG. 5, during horizontal leveling or slope finishing, proportional control solenoid valves 35 for boom 15*bm*, stick 15*st*, and bucket 15*bk* are electrically controlled based on signals computed by closed-loop control compensators 52*b*, 52*st*, 52*bk*. Closed-loop control compensators 52*b*, 52*st*, 52*bk* eliminate differences between the feedback signals 18 and the target signals computed by the microcomputer to actuate the respective cylinders. To automatically constrain the locus of points defined by movement of the bucket teeth (for example, to a plane), and maintain the bucket angle constant, during horizontal leveling or slope finishing, solenoid valves 35 proportionally control valves 36 for the boom, the stick, and the bucket so that respective pressures of hydraulic fluid output by control valves 36 extend or contract end effector actuating cylinders 14. Stick operating lever 33 and slope gradient setting device 41, used to set a target gradient θ of a finished slope A in ground preparation work, are connected to a computing unit 61. Computing unit 61 computes target speeds of respective end effector actuating cylinders 14. After the slope gradient setting device 41 sets finished slope gradient θ for forming slope A, the user simply moves stick operating lever 33 to instruct the system as to the desired target speed of the bucket teeth in the direction of digging. Computing unit 61 then computes and outputs the respective target positions and speeds of the end effector actuating cylinders 14.

An integrator 62 integrates the target positions and speeds output by computing unit 61 generating signals proportional to respective target positions of the boom, the stick and the bucket. The target position output line of integrator 62 and feedback loops 18 from respective angle sensors 16 are applied to inputs of a comparator 64. An output of comparator 64 is applied to a closed-loop control compensators 52. A multiplier gain-controls the output of comparator 64 responsively to feedback signal 71*a*.

Each closed-loop control compensator 52 has a compensating circuit for improving control characteristics of the feedback control system, such as stability, response speed and steady-state deviation. Control compensator 52 generates an output that controls the actuating cylinders so that the signal representing actual position of the boom, the stick, or the bucket precisely conforms with the target signal for actuating the corresponding cylinder, i.e. the target position of the boom, the stick or the bucket.

The solenoids and other suitable members of proportional control solenoid valves 35 are connected through an adder 67, an amplifier (not shown) and other necessary devices to closed-loop control compensators 52 described above. The output signal of computing unit 61, indicating target speed, is gain-controlled by a multiplier 68, and applied to an adder 67 forming a feedforward loop 69. The gain of multiplier 68 is controlled by feedback signal 71*b*.

Each of pressure detectors 32*bm* and 32 *st* is a differential pressure indicator composed of a pressure sensor 32*h* and a pressure sensor 32*r* respectively provided at the extension-side (the head-side) and the contraction-side (the rod-side) of the corresponding cylinder. Thus, each of pressure detectors 32*bm* and 32 *st* detects cylinder work load pressure, that is, the difference between the work load pressure detected by pressure sensor 32*h* at the extension-side and the work load pressure detected by pressure sensor 32*r* at the contraction-side.

Signal line 71, which conveys signals representing cylinder work load detected by pressure sensors 32*h* and 32*r*, branches into a feedback gain adjusting signal line 71*a* and a feedforward gain adjusting signal line 71*b*. Lookup table 72*a* is used to adjust the gain of the feedback signal. Lookup table 72*b* is used to adjust the gain of the feedforward signal. The signal indicating gain are applied to multipliers 65 and 68 by lines 71*a* and 7*b*, respectively.

While pressure sensors 32*h* and 32*r*, and lookup table 72*a*, constitute a feedback gain-adjusting device used to adjust the gain of the position-tracking feedback control system, pressure sensors 32*h* and 32*r* and lookup table 72*b* constitute a feedback gain adjusting device used to adjust the gain of feedforward loop 69. Both adjustments are made according to digging work load.

Lookup tables 72*a*, 72*b* store in their memories predetermined relationships between work load of cylinders including stick cylinder 14*st* and respective gains of feedback signals and feedforward signals to automatically adjust the gains by reducing or increasing them according to cylinder work load (digging force) detected by pressure sensors 32*h*, 32*r*. The portion of feedback gain adjusting signal line 71*a* passing through lookup table 72*a* is connected to multiplier 65, while the portion of feedforward gain adjusting signal line 71*b* passing through lookup table 72*b* is connected to multiplier 68.

With the configuration described as above, where gains of feedback signals and feedforward signals are automatically reduced or increased by lookup tables 72*a*, 72*b* according to fluctuation in cylinder work load obtained by pressure sensors 32*h*, 32*r*, the invention is capable of improving the precision in position tracking of stick cylinder 14*st* with respect to such disturbance as digging work load. By increasing the gain, the above configuration makes effective use of the integral compensation added to closed-loop control compensators 52 to reduce deviation of actual positions of stick 15*st* and the like from their target positions. This improves the finishing precision in horizontal leveling or slope finishing, shown in the drawings.

While semi-automatically performing slope formation, for example, should the digging load be judged to have increased by increase of the pressure at the extension-side (the head-side) of stick cylinder 14*st,* gains of feedback signals and feedforward signals are automatically increased by respective lookup tables 72*a,* 72*b.* A large digging work load corresponds to abundant load material (earth/sand) around bucket 15*bk*, which resulting in heavier attenuation of movement of the front linkage. Because of the attenuation, the control system is disinclined toward instability even as the gains of feedback signals and feedforward signals are increased. Where the digging work load is small, lookup tables 72*a,* 72*b* automatically reduce the gains of feedback signals and feedforward signals, thereby insuring stable control.

Note that although according to the embodiments described, loads on the end effector are sensed by measuring hydraulic pressure, any of a number of alternatives would occur to a person of ordinary skill based on the above disclosure. For example, strain gauges, solid-state and electro-mechanical force-sensors could be applied to the invention to achieve the same benefits discussed above. At least some of the claims appearing below are intended to embrace such alternatives.

Note also that although the present application discusses the invention in connection with the control of a back hoe, it is clear from the disclosure that the invention is applicable other kinds of equipment. For example, scrapers, raking machines, cranes. In fact, the invention need not be applied for surface finishing because any kind of position-tracking equipment could be made to operate in a more coordinated manner by augmenting the control system using load detection as described. Such variations are considered to fall within the scope of at least some of the claims.

Note also that although the invention has been described in connection with hydraulic equipment, it is applicable to equipment that uses other types of actuators. At least some of the claims are drafted embrace such alternatives.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures. Thus although a nail and screw may not be structural equivalents in that a nail relies entirely on friction between a wooden part and a cylindrical surface whereas a screw's helical surface positively engages the wooden part, in the environment of fastening wooden parts, a nail and a screw may be equivalent structures.

What is claimed is:

1. A control method for controlling a piece of construction equipment that has a position-sensing feedback control system to track respective positions of an actuator that controls positions of an end effector, comprising the steps of:

generating a target value for an actual force-load acting on said actuator generated in response to a forcing of said end effector against a working material;

detecting said actual force-load acting on said actuator; and modifying a control signal of said feedback control system responsively to a result of said step of detecting and said target value.

2. A method as in claim 1, wherein said step of detecting includes detecting a pressure of hydraulic fluid of said actuator.

3. A method as in claim 2, wherein said step of detecting includes detecting a differential pressure of a hydraulic fluid acting on extension and retraction sides of a linear actuator.

4. A method as in claim 1, wherein said step of detecting includes detecting a differential pressure of hydraulic fluid acting on extension and retraction sides of a hydraulic linear actuator.

5. A method as in claim 1, wherein said step of modifying includes establishing a target speed of a component of movement of said end effector, said component being chosen to affect said actual force-load.

6. A method as in claim 1, further comprising the steps of:

establishing a priority between a position-tracking control-goal of said position-sensing feedback control system and said target-value of said force-load;

generating at least one of a target speed of said actuator and a target position of said actuator responsively to said step of establishing a priority.

7. A method as in claim 6, wherein:

said load force-load being proportional to a soil compaction force generated by said piece of construction equipment;

said step of generating at least one of a target speed of said actuator and a target position of said actuator includes determining a position of said end effector in a direction normal to a surface worked by said piece of construction equipment.

8. A method as in claim 1, wherein:

said load force-load being proportional to a soil compaction force generated by said piece of construction equipment;

said step of generating includes determining a position of said end effector in a direction normal to a surface worked by said piece of construction equipment.

9. An apparatus for controlling an end effector of a construction machine that employs a feedback control system to track respective positions of at least one actuator that moves said end effector comprising:

a pressure sensor connected to said at least one actuator to communicate with a hydraulic fluid whose pressure is responsive to a work load affecting said end effector;

a work load-setting indicator to allow a user to set a desired signal indicating a target work load;

a work load control portion connected to receive said signal indicating a target work load, said work load control portion being connected to said feedback control system to track respective positions such that a tracking of said feedback control system is responsive to said signal indicating a desired work load and a pressure signal of said pressure sensor.

10. An apparatus as in claim 9, further comprising:

a user-actuated priority indicating device; and means for altering a sensitivity of a response of said feedback control system to track respective positions to said work load control portion.

11. An apparatus for controlling an end effector of a construction machine that employs a feedback control system for tracking respective positions of end effector actuators, comprising:

a feedforward loop in said position-tracking feedback control system; and an amplifier connected to modulate a signal in said feedforward loop;

a gain of said amplifier being responsive to a work load applied to said end effector.

12. An apparatus as in claim 11, further comprising:

a force-sensor connected to said actuator to detect said work load;

an output of said force sensor connected to a gain-adjusting input of said amplifier, whereby said gain is adjusted in response to an output of said force-sensor.

13. An apparatus as in claim 12, wherein:

said actuator includes a hydraulic cylinder;

said force-sensor includes a pressure sensor connected to said hydraulic cylinder and in communication with a hydraulic fluid of said hydraulic cylinder.

14. An apparatus for controlling an end effector of a construction machine that employs a feedback control system for tracking respective positions of end effector actuating cylinders, said apparatus including:

a feedforward loop in said feedback control system;

a feedforward amplifier in said feedforward loop to adjust a gain of said feedforward loop;

a detector, connected to said feedforward amplifier for detecting a digging work load applied upon said end effector actuating cylinders;

said gain of said feedforward amplifier being continuously adjustable responsively to said detector; and a feedback loop with a feedback amplifier in said feedback loop to adjust a gain of a feedback signal of said feedback loop;

said gain of said feedback amplifier being continuously adjustable responsively to said detector.

15. An apparatus as in claim 14 wherein:

said construction machine includes a hydraulic cylinder;

said detector includes a pressure sensor in communication with a hydraulic fluid of said hydraulic cylinder;

said feedforward loop amplifier is connected to said detector through a filter that controls said gain of said feedforward amplifier responsively to said detector and a first set of data stored in a memory, said data indicating a relationship between a desired gain of said feedforward amplifier and digging work load.

16. A apparatus as in claim 15 wherein said feedback amplifier is connected to said detector through a second filter that controls said gain of said feedforward amplifier responsively to said detector and a second set of data stored in a memory, said second set of data indicating a relationship between a desired gain of said feedback amplifier and digging work load.

17. An apparatus as in claim 14, wherein said feedback amplifier is connected to said detector through a second filter that controls said gain of said feedforward amplifier responsively to said detector and data stored in a memory, said data indicating a relationship between a desired gain of said feedback amplifier and digging work load.

18. A method of controlling a hydraulic construction machine having a feedback position control system, comprising the steps of:

storing an indication of a desired position constraint for an end effector of said construction machine;

storing an indication of a desired speed of said end effector;

monitoring a working force applied to said end effector;

a signal responsive to a position of said end effector being applied through a feedback loop of said feedback position control system;

amplifying said signal responsively to results of said step of monitoring a working force.

19. A method as in claim 18, further comprising the step of amplifying a feedforward signal, responsive to at least one of a stored indication of a desired speed and a stored indication of a desired position constraint, responsively to said working force.

20. A method as in claim 19, wherein said step of amplifying includes adjusting a gain in response to function stored in a memory.

* * * * *